US010022578B2

(12) United States Patent
Kelly

(10) Patent No.: US 10,022,578 B2
(45) Date of Patent: Jul. 17, 2018

(54) MUSCLE THERAPY DEVICE

(71) Applicant: Modern Hygiene, LLC, Venice, CA (US)

(72) Inventor: Ray Kelly, Venice, CA (US)

(73) Assignee: Modern Hygiene, LLC, Los Angeles, CA (US)

( * ) Notice: Subject to any disclaimer, the term of this patent is extended or adjusted under 35 U.S.C. 154(b) by 19 days.

(21) Appl. No.: 15/218,011

(22) Filed: Jul. 23, 2016

(65) Prior Publication Data

US 2017/0021219 A1 Jan. 26, 2017

Related U.S. Application Data

(60) Provisional application No. 62/195,793, filed on Jul. 23, 2015.

(51) Int. Cl.
*A61H 15/00* (2006.01)
*A61H 7/00* (2006.01)
(Continued)

(52) U.S. Cl.
CPC ..... *A63B 21/0442* (2013.01); *A61H 7/001* (2013.01); *A61H 15/00* (2013.01);
(Continued)

(58) Field of Classification Search
CPC ..... A61H 7/001; A61H 15/00; A61H 2015/0042; A61H 2201/0123;
(Continued)

(56) References Cited

U.S. PATENT DOCUMENTS 1,714,391 A * 5/1929 McWhirter ..... A63B 21/015 482/148
2,935,321 A * 5/1960 Rudolf ..... A63B 15/00 273/317

(Continued)

OTHER PUBLICATIONS

Balls 'N' Bands. Fit-Stix Break Apart Exercise Body Bar. http://www.ballsnbands.com/fit-stik_break_apart_body_bar.html (downloaded Jul. 25, 2016).

(Continued)

*Primary Examiner* — Loan H Thanh
*Assistant Examiner* — Gary D Urbiel Goldner
(74) *Attorney, Agent, or Firm* — Loza & Loza, LLP; Heidi Eisenhut

(57) ABSTRACT

Embodiments of the present disclosure are directed to a portable muscle therapy device that can be used for physical therapy, fitness and exercise by creating compression to a joint/muscle while performing movement exercise (flossing) to restore mobility and pain relief. The muscle therapy device may include an elongated shaft comprised of a plurality of detachable segments that allow a user to change a length of the elongated shaft and convert the elongated shaft into separate bars. For example two bars may be formed, one for each hand of the user, and a resistance band may be attached to each bar. Additionally, the muscle therapy device of the present disclosure provides for an ability to attach a handle on one end of the elongated shaft to mimic a canoeing and stand up paddle for back, core and shoulder exercise.

18 Claims, 11 Drawing Sheets

(51) Int. Cl.

| | |
|---|---|
| ***A63B 21/00*** | (2006.01) |
| ***A63B 21/002*** | (2006.01) |
| ***A63B 21/04*** | (2006.01) |
| ***A63B 21/055*** | (2006.01) |
| ***A63B 21/16*** | (2006.01) |
| ***A63B 23/02*** | (2006.01) |
| ***A63B 23/025*** | (2006.01) |
| ***A63B 23/035*** | (2006.01) |
| ***A63B 23/12*** | (2006.01) |
| ***A63B 26/00*** | (2006.01) |
| ***A63B 69/06*** | (2006.01) |
| ***A63B 71/02*** | (2006.01) |

(52) U.S. Cl.

CPC ..... *A63B 21/002* (2013.01); *A63B 21/0552* (2013.01); *A63B 21/0557* (2013.01); *A63B 21/16* (2013.01); *A63B 21/1663* (2013.01); *A63B 21/4033* (2015.10); *A63B 21/4035* (2015.10); *A63B 23/0233* (2013.01); *A63B 23/03516* (2013.01); *A63B 23/03525* (2013.01); *A63B 23/03541* (2013.01); *A63B 23/1209* (2013.01); *A61H 2015/0042* (2013.01); *A61H 2201/0123* (2013.01); *A61H 2201/0126* (2013.01); *A61H 2201/0153* (2013.01); *A61H 2201/0157* (2013.01); *A61H 2201/164* (2013.01); *A61H 2201/1614* (2013.01); *A61H 2201/1623* (2013.01); *A61H 2201/1635* (2013.01); *A61H 2201/1695* (2013.01); *A61H 2203/0406* (2013.01); *A61H 2203/0456* (2013.01); *A63B 21/169* (2015.10); *A63B 21/1645* (2013.01); *A63B 23/025* (2013.01); *A63B 23/0222* (2013.01); *A63B 23/03508* (2013.01); *A63B 26/003* (2013.01); *A63B 71/023* (2013.01); *A63B 2069/068* (2013.01); *A63B 2208/0204* (2013.01); *A63B 2208/0252* (2013.01); *A63B 2209/02* (2013.01); *A63B 2209/10* (2013.01); *A63B 2210/50* (2013.01); *A63B 2225/093* (2013.01)

(58) Field of Classification Search

CPC .... A61H 2201/0126; A61H 2201/0153; A61H 2201/0157; A61H 2201/1614; A61H 2201/1623; A61H 2201/1635; A61H 2201/164; A61H 2201/1695; A61H 2203/0406; A61H 2203/0456; A63B 15/00; A63B 21/0004; A63B 21/00043; A63B 21/00058; A63B 21/00061; A63B 21/00065; A63B 21/00069; A63B 21/00072; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/08; A63B 21/15; A63B 21/151; A63B 21/159; A63B 21/16; A63B 21/1609; A63B 21/1618; A63B 21/1627; A63B 21/1636; A63B 21/1645; A63B 21/1654; A63B 21/1663; A63B 21/1672; A63B 21/1681; A63B 21/169; A63B 21/28; A63B 21/285; A63B 21/4023; A63B 21/4025; A63B 21/4027; A63B 21/4033; A63B 21/4035; A63B 21/4039; A63B 21/4043; A63B 21/4045; A63B 21/4047; A63B 21/4049; A63B 23/02; A63B 23/0205; A63B 23/0211; A63B 23/0216; A63B 23/0222; A63B 23/0227; A63B 23/0233; A63B 23/025; A63B 23/035; A63B 23/03508; A63B 23/03516; A63B 23/03525; A63B 23/03533; A63B 23/03541; A63B 23/0355; A63B 23/03575; A63B 23/04; A63B 23/0405; A63B 23/0458; A63B 23/0464; A63B 23/0482; A63B 23/0488; A63B 23/0494; A63B 23/12; A63B 23/1209; A63B 23/1218; A63B 23/1227; A63B 23/1236; A63B 23/1245; A63B 23/1263; A63B 23/1272; A63B 23/1281; A63B 2023/0411; A63B 26/00; A63B 26/003; A63B 69/0057; A63B 69/0069; A63B 69/06; A63B 2069/062; A63B 2069/068; A63B 71/0054; A63B 71/023; A63B 2071/0063; A63B 2071/0072; A63B 2071/026; A63B 2071/027; A63B 2208/0204; A63B 2208/0242; A63B 2208/0252; A63B 2210/00; A63B 2210/50; A63B 2225/09; A63B 2225/093

See application file for complete search history.

(56) References Cited

U.S. PATENT DOCUMENTS

| | | | | |
|---|---|---|---|---|
| 3,119,614 | A * | 1/1964 | Berry | A63B 21/0004 482/91 |
| 3,256,015 | A * | 6/1966 | Perrin | A63B 21/04 24/129 C |
| 3,740,033 | A * | 6/1973 | Kamp | A63B 21/015 482/115 |
| 4,664,373 | A * | 5/1987 | Hait | A63B 21/0603 482/109 |
| 5,125,649 | A * | 6/1992 | Fuller | A63B 21/0004 482/106 |
| 5,190,512 | A * | 3/1993 | Curran | A63B 21/0004 482/122 |
| 5,403,256 | A * | 4/1995 | Squires | A63B 9/00 482/148 |
| 5,643,161 | A * | 7/1997 | Gordon | A63B 21/026 482/122 |
| 5,778,914 | A | 7/1998 | Trani | |
| 6,022,297 | A * | 2/2000 | DeJesus | A63B 23/0494 482/70 |
| 6,402,670 | B1 * | 6/2002 | Anagnostou | A63B 21/0004 482/148 |
| 6,887,187 | B1 * | 5/2005 | Renz | A63B 21/16 482/57 |
| 6,938,927 | B1 * | 9/2005 | Martin | A45B 7/00 135/69 |
| 7,090,627 | B1 * | 8/2006 | Walker | A63B 21/055 482/121 |
| 7,918,773 | B2 | 4/2011 | Brennan et al. | |
| 8,083,653 | B2 | 12/2011 | Hetrick | |
| 9,457,216 | B2 * | 10/2016 | Lagree | A63B 21/0004 |
| 2002/0198081 | A1 * | 12/2002 | Chen | A63B 21/00181 482/8 |
| 2005/0113223 | A1 * | 5/2005 | Dovner | A63B 21/0004 482/121 |
| 2006/0160463 | A1 * | 7/2006 | Orr | A63B 15/00 446/236 |
| 2007/0184946 | A1 * | 8/2007 | Kuhagen | A63B 21/02 482/110 |
| 2008/0081747 | A1 * | 4/2008 | Mok | A63B 21/0004 482/121 |
| 2009/0149304 | A1 * | 6/2009 | Smith | A63B 21/00043 482/126 |

(56) References Cited

U.S. PATENT DOCUMENTS

2009/0170671 A1* 7/2009 Faktenmark ..... A63B 21/0004 482/122
2009/0264267 A1* 10/2009 Ballif ..... A63B 21/0004 482/139
2009/0280965 A1* 11/2009 Shapiro ..... A63B 69/06 482/72
2009/0291779 A1* 11/2009 Wilton ..... A63B 69/0088 473/425
2010/0173760 A1* 7/2010 Hall ..... A63B 21/0552 482/129
2011/0143891 A1 6/2011 Brennan et al.
2011/0251026 A1* 10/2011 Stephan ..... A63B 21/0004 482/93
2012/0149539 A1* 6/2012 Quader ..... A63B 21/08 482/109
2012/0214651 A1 8/2012 Ross
2013/0012851 A1* 1/2013 Fahmie ..... A61H 7/003 601/119
2014/0287852 A1* 9/2014 Clark ..... A63B 69/0002 473/424
2015/0141217 A1* 5/2015 Young ..... A63B 21/0442 482/126
2015/0265486 A1* 9/2015 Fiore ..... A61H 7/003 601/136
2015/0320160 A1* 11/2015 Whiteley ..... A61H 3/02 135/77
2016/0067579 A1* 3/2016 Fitzgerald ..... A63B 69/0059 473/513
2016/0095397 A1* 4/2016 Crowhurst ..... A45B 9/00 135/66

OTHER PUBLICATIONS

Graston Technique. "Faster and Better outcomes—redefining patient care and praatice success." http://www.grastontechnique.com (downloaded Jul. 14, 2016).
Sporting Tools. "Fitness Stick." http://www.sportingtools.in/sport/fitness-stick.html (downloaded Jul. 18, 2016).
Trx. "The TRX rip trainer basic kit." https://www.trxtraining.com/products/trx-rip-trainer-basic-kit (downloaded Jul. 14, 2016).
International Search Report & Written Opinion for PCT/US16/43775 dated Dec. 8, 2016; 7 pages.

* cited by examiner

MUSCLE THERAPY DEVICE

CROSS REFERENCE TO RELATED APPLICATIONS

This application claims priority to a provisional application, U.S. Ser. No. 62/195,793, filed Jul. 23, 2015, entitled MUSCLE THERAPY DEVICE, which is hereby incorporated by reference.

FIELD

The present disclosure relates to a muscle therapy device that can be used for physical therapy, fitness and exercise. More particularly, the present disclosure is directed to a portable device for performing physical therapy treatment by creating compression to a joint/muscle while performing movement exercise (flossing) to restore mobility and pain relief.

BACKGROUND

Physical therapy is an important aspect of not only an individual's recovery from an illness or injury by restoring the body's function and movement, but is also an important aspect in maintaining an individual's well-being and/or improving physical abilities. For example, physical therapy can be used to activate important muscle groups in the neck, trunk, abdomen and hip muscles, all of which are crucial in maintaining balance and stability and preventing falls.

As not everyone has access to physical therapists, devices that individuals can use at home or travel with are desirable. There are many devices on the market that aim to replicate specific techniques commonly used by physical therapists and chiropractors to treat neck and shoulder dysfunction along with many other rehabilitation techniques by the use of compression using one's bodyweight. The problems and deficiency in these products are not necessarily the product itself, but lies in the lack of joint and muscle mobilization exercise that can be done before performing the exercise the bar has to offer. The technology in mobilization and compression flossing as an aid to restore a dysfunctional movement pattern cannot be performed with the conventional products being sold. If there is restriction in the neck and shoulder, it is not an effective tool for rehabilitation without using the function of compression flossing before using the bar as a functional training bar. With a functional training bar, users typically attach a bar to either a large pulley weighted machine or portable door anchor that can often be found in gyms and available online.

During rehabilitation exercises, the dominant overactive muscle group needs to be released before performing any of the exercises the functional fitness bar can offer. That is, compression flossing should be performed before utilizing the functional training bar in order to maximize the benefit from the functional training bar.

One home do-it-yourself method of rehabilitation has been to take a tennis ball (or other type of ball such as a lacrosse ball) and cut a hole in it and placing it on a wooden stick. However, this do-it-yourself version is risky and dangerous as the ball is not securely attached to the stick and it does not allow for various sizes or ball density (from soft to firm) to be easily interchanged for different muscle groups or exercises. Additionally, this do-it-yourself version does not offer secure attachment points to allow versatility by adding a resistance band to the movements and offer various ranges of difficulty. It is also not portable for travel.

It is also known to use balls (such as rubber balls, lacrosse balls, tennis balls and yoga balls) on their own as the user can lay on them using their body weight to penetrate trigger points and tight muscles, however it is not possible to access the deep muscle of the neck and shoulder effectively without the pole component while keeping the spine straight and supported on the floor.

Other common methods utilized for neck and shoulder dysfunction are a towel traction method and a scraping technique, however with each of these methods it is difficult to access the areas of muscle dysfunction without the shaft. Other known treatment methods for neck, shoulder and first, second rib dysfunction and thoracic outlet syndrome include (1) the Graston Technique which uses a tool that scrapes the soft tissue to encourage healing; (2) the Active Release Technique; and (3) Massage—Trigger Point Therapy, Chiropractic and Physical Therapy.

The problems and deficiency in these products are not necessarily the products themselves, but instead lie in the lack of joint and muscle mobilization exercise a user can do before performing the exercise the bar has to offer. The technology in mobilization and compression flossing as an aid to restore a dysfunctional movement pattern cannot be performed with the standard bars currently being sold. If there is restriction in the neck and shoulder, it is not an effective tool for rehabilitation without using the compression flossing function before the user uses the bar for functional bar training.

For rehabilitation, the dominant overactive muscle group needs to be released before performing any of the exercises the functional fitness bar can offer. The user needs the component of compression flossing in order to maximize the use of the functional fitness bar.

Furthermore, the above mentioned products have a fixed bar limiting the volume of movements to cater for muscular or joint imbalances. The fitness bars currently available also do not replicate the feel and correct movement for rowing, canoeing and stand up paddle boarding (SUP)—a key movement in back, shoulder, core and spine rehab.

The muscle therapy device of the present disclosure overcomes these problems and disadvantages with known devices. As described in more detail below, the muscle therapy device of the present disclosure may include an elongated shaft comprised of a plurality of detachable segments that allow the user to change the length of the elongated shaft (i.e. bar), convert the elongated shaft into separate bars, one in each hand and attach a resistance band on each bar.

The muscle therapy device of the present disclosure also provides for the ability to attach a handle on one end of the elongated shaft to mimic a canoeing and stand up paddle for back, core and shoulder exercise.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one aspect, a portable muscle therapy device is provided. The portable therapy device includes an elongated shaft extending along an axis and having a proximal end and a distal end; one or more attachment points located on the elongated shaft; one or more attachment members adapted to be received in the one or more attachment points, the one or more attachment members securing an object to the elongated shaft; and a therapy tool received in the distal end of the elongated shaft.

According to one feature, the object may include a resistance band or a door anchor. The therapy tool may be a ball or a handle.

According to another feature, the device may further comprise a base received in the proximal end of the elongated shaft.

According to yet another feature, the elongated shaft comprises a plurality of detachable segments secured together by a first locking mechanism and a second locking mechanism. The first locking mechanism selectively locks a first segment in the plurality of segments to a second segment in the plurality of segments along the axis; and the second locking mechanism selectively locks the second segment in the plurality of segments to a third segment in the plurality of segments along the axis. The first locking mechanism comprises a pushable button on an end of the first segment and a plurality of holes extending along a longitudinal axis of the second segment; and where the button is received in a hole in the plurality of holes detachably securing the first segment to the second segment.

According to another aspect, a portable muscle therapy device is provided. The device comprises an elongated shaft extending along an axis and having a proximal end and a distal end, the elongated shaft comprising a plurality of detachable segments; one or more attachment points located on one or more of the plurality of detachable segments; one or more attachment members adapted to be received in the one or more attachment points, the one or more attachment members securing an object to the elongated shaft; and a first therapy tool received in the distal end of the elongated shaft.

According to one feature, the device may further comprise a base detachably secured to the proximal end of the elongated shaft.

According to another feature, the device may further comprise a handle detachably secured to the proximal end of the elongated shaft adapted to be placed against a portion of a first user's body when in use and wherein the object is adapted to be placed against a portion of a second user's body when in use. A padded cushion secured to an end of the handle.

According to yet another feature, the plurality of segments include at least a first segment and a second segment; and wherein adjoining ends of the first and second are cut on 45 degree angles.

According to yet another feature, the device further comprises a first locking mechanism for selectively locking the first segment in the plurality of segments relative to the second segment in the plurality of segments along the axis; and a second locking mechanism for selectively locking the second segment in the plurality of segments relative to a third segment in the plurality of segments along the axis. The first locking mechanism comprising a pushable button on an end of the first segment and a plurality of holes extending along a longitudinal axis of the second segment; and where the button is received in a hole in the plurality of holes detachably securing the first segment to the second segment.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

Figure 1:
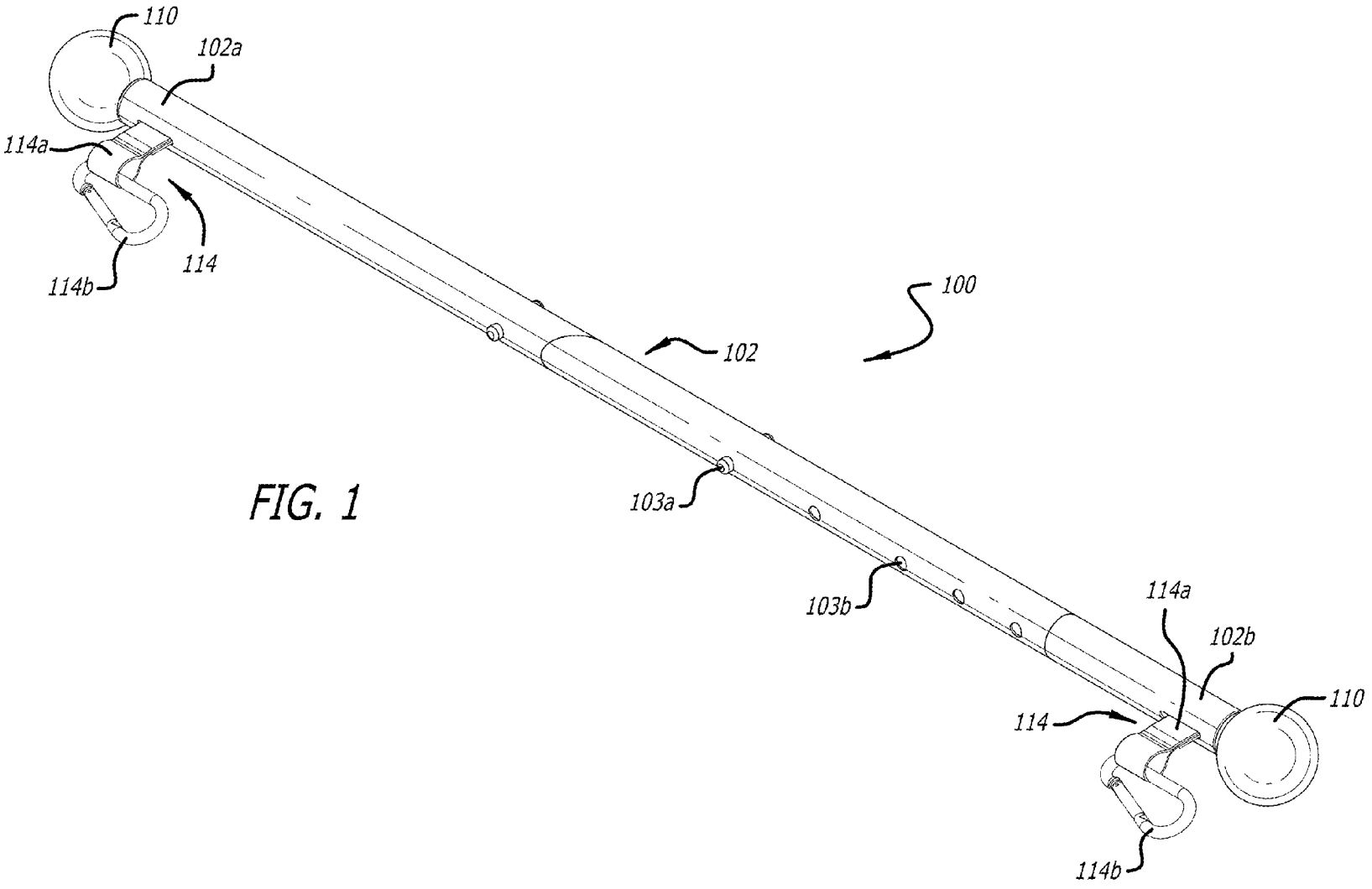
FIG. 1 is a top left perspective view of a first side of a muscle therapy device according to one embodiment.
Figure 2:
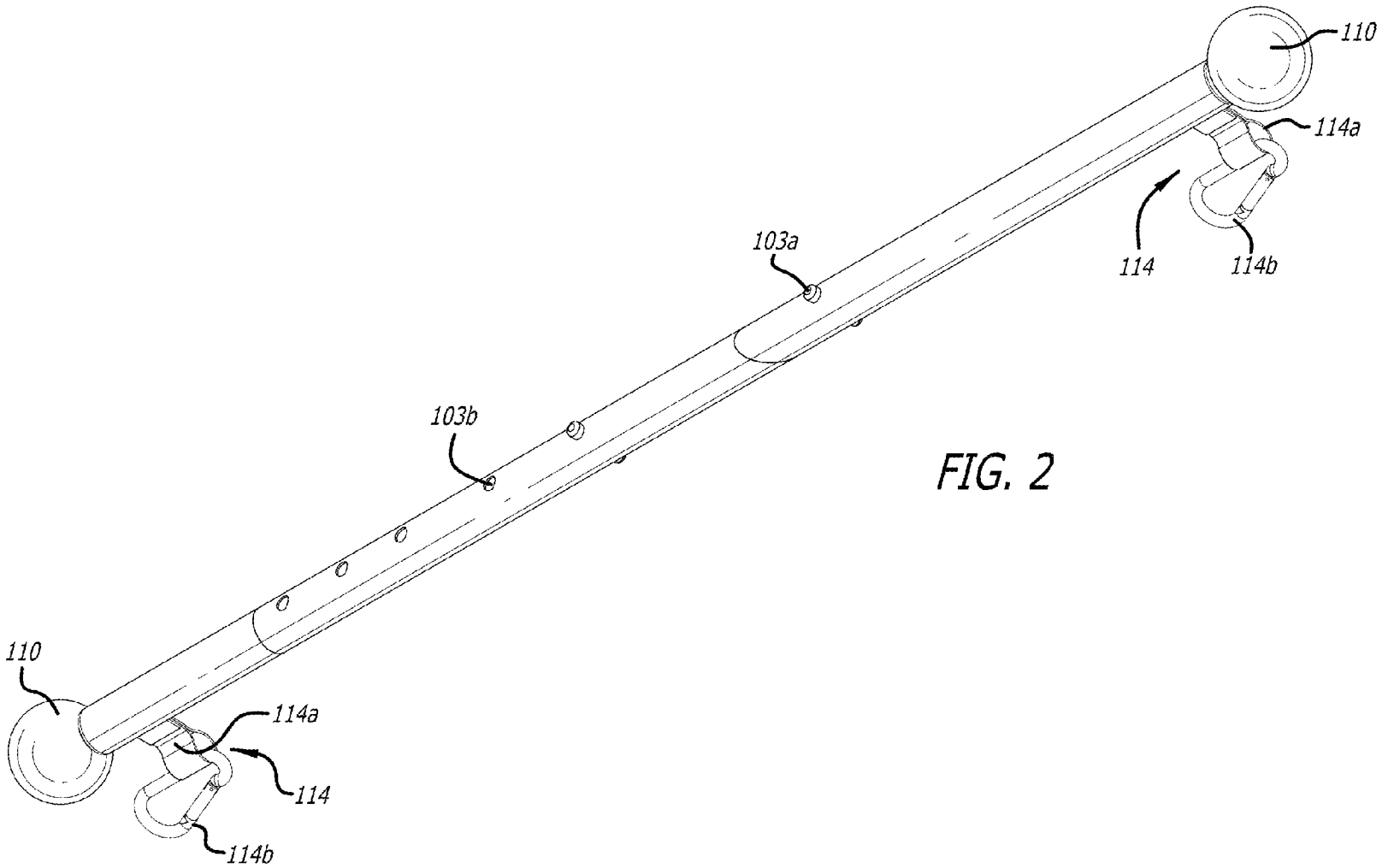
FIG. 2 is a top left perspective view of a second side of the muscle therapy device of FIG. 1.
Figure 3:
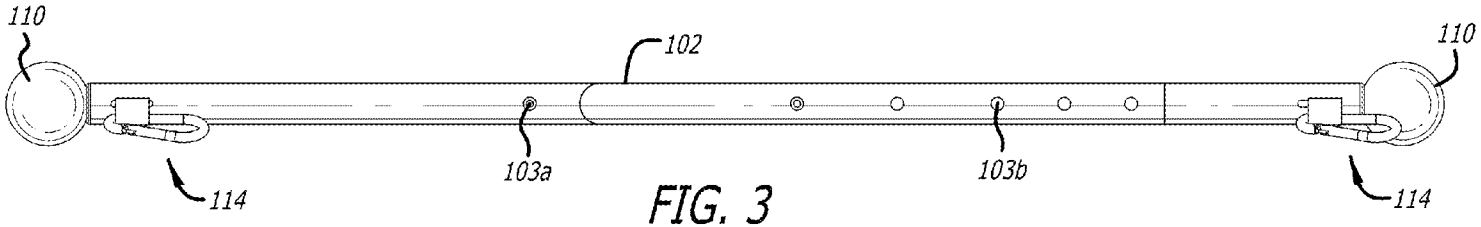
FIG. 3 is a first side elevation of the muscle therapy device of FIG. 1.
Figure 4:
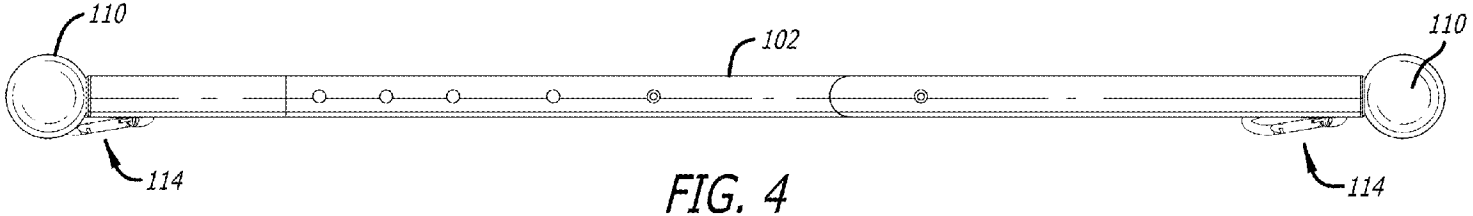
FIG. 4 is a second side elevation of the muscle therapy device of FIG. 1.
Figure 5:
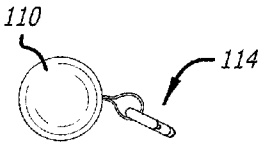
FIG. 5 is a back elevation view of the muscle therapy device of FIG. 1.
Figure 6:
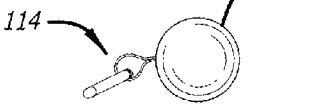
FIG. 6 is a front elevation view of the muscle therapy device of FIG. 1.
Figure 7:
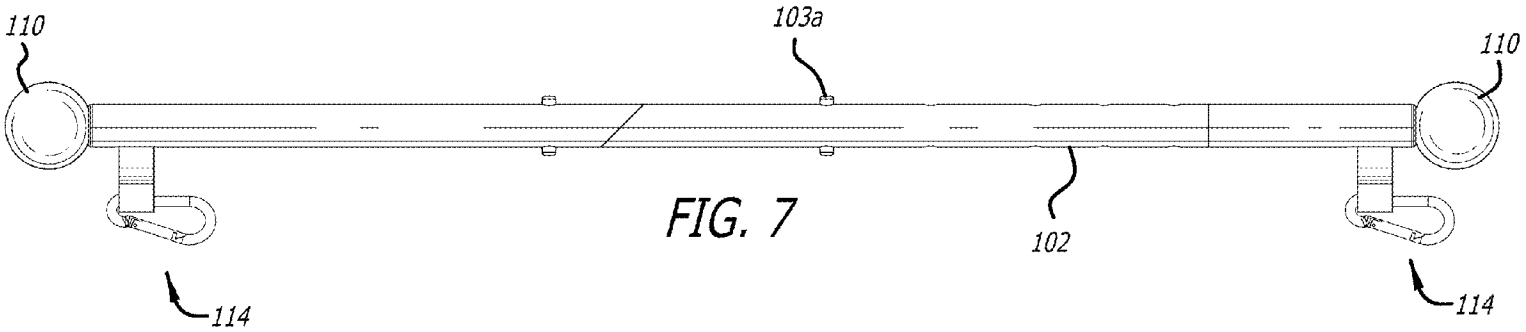
FIG. 7 is a top plan view of the muscle therapy device of FIG. 1.
Figure 8:
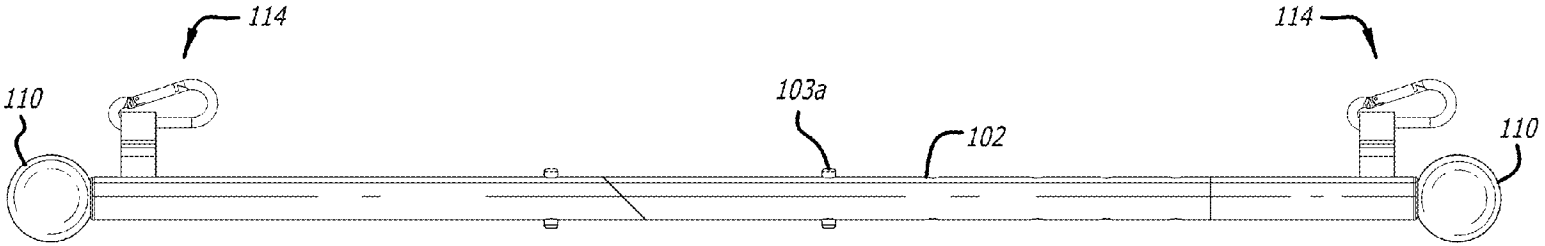
FIG. 8 is a bottom plan view of the muscle therapy device of FIG. 1.

In the following description, specific details are given to provide a thorough understanding of the embodiments. However, it will be understood by one of ordinary skill in the art that the embodiments may be practiced without these specific details.

The present disclosure is directed to a portable muscle therapy device for physical therapy, fitness and exercise that allows individuals to apply compression to a specific joint/muscle in the body while performing movement exercise to restore mobility and pain relief. That is, the device of the present disclosure allows an individual to perform nerve flossing to relieve pain and restore mobility.

Overview

The muscle therapy device disclosed herein is a multi-functional pain and rehabilitation tool that allows a user or patient to perform physical therapy on themselves. It can be used to not only rehabilitate dysfunctional joints and muscles (specifically addressing neck, shoulder, first rib and hip dysfunction), but also to restore correct movement patterns through compression and movement. The muscle therapy device can be used in a variety of ways within its at least three main functions from injury rehabilitation, by use of compression flossing, to a fully functional exercise bar, by using as a functional training bar and the use by practitioners/therapists/trainers to perform flossing/active release exercises using a handle detachable secured to the device.

According to one aspect, the muscle therapy device may include an elongated shaft having a plurality of detachable segments that can be easily disassembled for travel. As described in more detail below, a push pin or button technology may be used to adjust lengths of the elongated shaft. The elongated shaft may be made from any material known in the art, such as carbon fiber, aluminum, wood and plastics. The elongated shaft is also designed to receive a number of external attachments for various functions changing the tool (or device) from a device for compression flossing to a functional training bar. The attachments may include a variety of different ball heads, for example rubber balls, that come in various sizes and densities that have been modified with a hole drilled into it with a plastic sleeve lock placed in the ball that screws onto the top adjustable end of the pole. In other words, the balls may threadingly engage with the elongated shaft.

According to another aspect, the elongated shaft may include multiple attachment points to which attachment members may be secured. An attachment member may include a strap extending outwardly from the elongated shaft and a carabineer clip (or similar device or securing member) secure to the strap. Alternatively, the securing member may be secured directly to the elongated member without the strap. The attachment member may be used to attach a standard or customized resistance band or a door anchor, for example, to the elongated shaft or other part of the muscle therapy device. So the it may be used as a strength and mobility device. Alternatively, where there is a hole designed in both ends of the shaft to attach the resistance bands, a sliding clamp or clip may be utilized that can slide up and down the elongated shaft to offer greater choices of lengths for attaching the resistance bands.

According to yet another aspect, rubber or padded grips may be located on the elongated shaft to add comfort for the user.

According to yet another aspect, instead of using push pin technology to adjust the length of the elongated shaft, an elastic cord may be inserted through the inner part of the elongated shaft so when the segments of the elongated shaft are pulled apart, the segments can fold up yet still stay intact to reduce the risk of losing one of the segments.

According to yet another aspect, instead of using push pin technology to adjust the length of the elongated shaft, an external clamp or sliding clamps along the length of the elongated shaft may be used.

According to yet another aspect, the elongated shaft may be made as a single pole, a two piece pole or other multiple pole piece.

According to yet another aspect, instead of a screw component for attaching the ball to the elongated shaft, a push pin or clamp connector may be utilized.

According to yet another aspect, a set of 2-6 joined roller blade wheels attached to a screw may be attached to the elongated shaft with a sleeve lock connector as is used for connecting the balls.

The muscle therapy device described herein can take a user through all the stages of therapy from the rehabilitation to the fully functional training in one simple, lightweight, portable tool. It offers deep and soft tissue massage, physical therapy and strength and fitness training all in one device. There are three stages to effectively restoring movement and pain reduction with the muscle therapy device. When there is dysfunction of a joint or muscle, there is an imbalance occurring creating an unnatural movement pattern blocking the natural improvement of a joint or muscle. The muscle therapy device takes the user through all three stages from rehab to fully functional movements.

The first stage is compression flossing which is a technique that uses the body's own natural movement patterns to communicate correct use of muscles and break down unhealthy tissue often performed by a therapist in assuage or physical therapy. The compression created by the ball may act as a block to the dominant muscle creating the dysfunction.

The second stage is mobility. Once the block has been created with the compression ball, resistance bands may be added to the elongated shaft to activate the opposing weaker muscle for strengthening as the dominant/overactive muscles that are being blocked. This shifts the balance of the strong and weak muscles.

The third stage is kinetic integration so that all of the muscles in the body to work together as one. As the elongated shaft converts into a full body workout bar, integration of the new restored movement pattern that has been learned in the first stage occurs along with implementation of functional movements with bar learned in the second stage.

Muscle Therapy Device

FIGS. 1-8 illustrate a muscle therapy device 100 according to a first embodiment. The portable muscle therapy device 100 may include an elongated shaft 102 extending along an axis and having a proximal end 102*a* and a distal end 102*b*. The elongated shaft 102 may be made of the strongest and most lightweight metal or other material that is available. For example, the elongated shaft 102 may be made of carbon fiber, aluminum or wood.

According to one aspect, the elongated shaft 102 may be comprised of a plurality of segments 104, 106, 108 (See FIG. 10) for adjusting the length of the elongated shaft 102. Although three segments 104, 106, 108 are shown, this is by way of example only and the elongated shaft 102 may include less than three segments or more than three segments. The segments may have the same lengths or be of different lengths. By utilizing a plurality of detachable segments, the elongated shaft 102 can be easily dismantled for storage or travel as well as allowing users to adjust the length of the elongated shaft 102 to better suit each individual user. In one example, some or all of the elongated shaft joining pieces may be cut on 45 degree angles to ensure the strongest possible connection in the shaft. This 45 degree locking cut maximizes force transfer through the elongated shaft 102.

Figure 10:
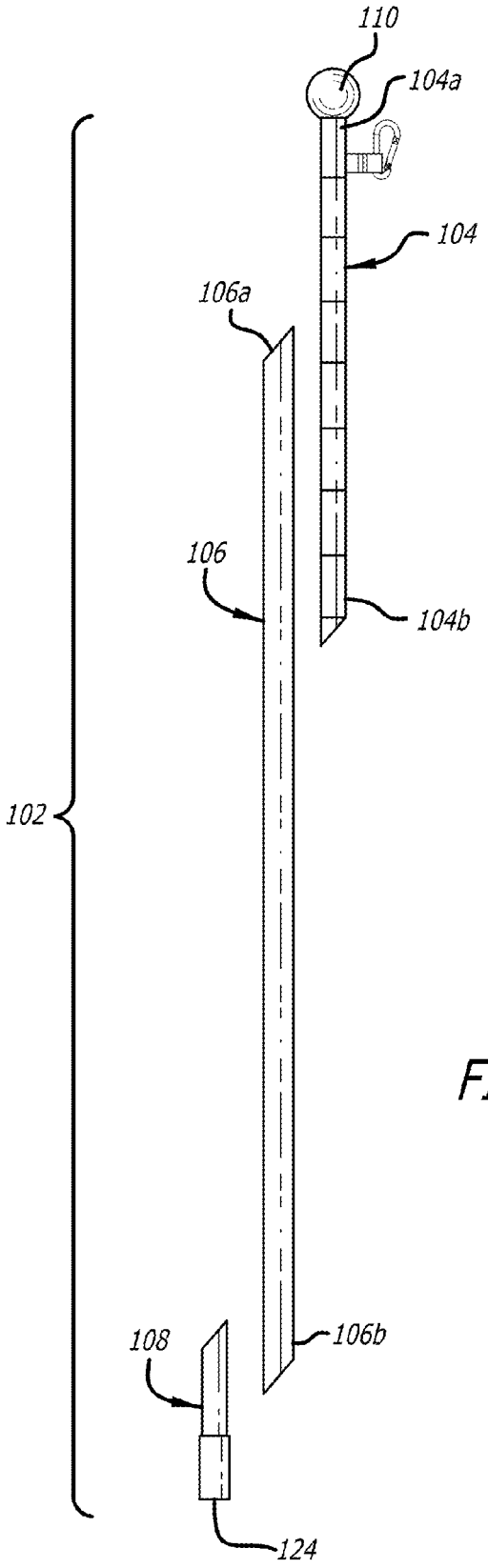
FIG. 10 is an exploded view of a muscle therapy device according to one embodiment.

Referring to FIG. 10, the first segment 104 has a distal end 104*a* defining the distal end of the elongated shaft 102 and a proximal end 104*b* adapted to be received in a distal end 106*a* of the second segment 106 while a proximal end 106*b* of the second segment is adapted to be received into the distal end 108*a* of the third segment 108. The proximal end 108*b* of the third segment 108 defines the proximal end 102*b* of the elongated shaft 102.

Locking mechanisms may be utilized for selectively locking the first segment 104 relative to the second segment 106 along the axis and locking the second segment 106 relative to the third segment 108 along the axis. According to one aspect, the locking mechanism may be comprised of a snap lock button 103*a* on one end of a segment and one or more holes 103*b* extending along the axis on one end of a different segment such that when an end of a segment having the snap lock button is inserted or fitted within an end of a segment having the one or more holes, the button is slid and snapped into (or engaged with) one of the holes releasably locking the two segments together. By utilizing a plurality of holes 103*b*, the user can easily adjust the elongated shaft 102 of the device to the appropriate length by the selection of the hole which the button engages. Alternatively, the segments may be locked together by threading engagement or any other type of locking mechanism known in the art. Being able to disassemble the muscle therapy device, and more particularly the elongated shaft, provides for portability as the disassembled shaft can easily fit in a small backpack, workbag or travel bag.

According to one aspect, the distal end 104*a* of the first segment 104 may be adapted to receive various attachments designed for performing different physical therapy treatments. For example, various sized and textured balls 110 or a hand contoured handle 112 (See FIG. 11) may be detachably coupled to the distal end 104*a* of the first segment 104. Although the attachments are described as being attached to the distal end 104*a* of the first segment 104, this is by way of example only and the attachments may be attached to any end of any segment of the device. Furthermore, attachments, either the same or different attachments, may be detachably coupled to both ends of the device, a single segment or detachably combined segments.

In one embodiment, either of the attachments (the ball 110 or the handle 112) may be threadingly secured to the distal end 104*a* of the first segment 104. The ability to utilize various types of ball head attachments offers the user a wide range of skin friendly rubber balls of different sizes and densities from soft to hard to allow for soft and deep tissue muscle repair and therapy. The attachments may also include a male/female connective sleeve lock that can secure tightly onto the shaft for safety and greater force transfer.

According to one aspect, when the ball attachment 110 is attached to the distal end 104*a* of the first segment 104 (or other segment), the muscle therapy device 100 may be used for compression therapy or flossing for working the nerves and muscles of an individual or user. The ball attachment 110 may be used to create compression to a forming movement exercise (flossing) to restore mobility and pain relief. Unlike typical devices, the rubber ball on the elongated shaft 102 of the muscle therapy device 100 described herein allows the user to effectively access a major area of neck and back pain, via the first rib. The position the muscle therapy device can get in is unlike any other device.

According to one aspect, when the hand contoured handle 112 is attached to the distal end 104*a* of the first segment 104 (or other segment), the muscle therapy device 100 may be used as a functional training bar providing a versatile portable device for physical therapy, fitness and exercise.

Figure 11:
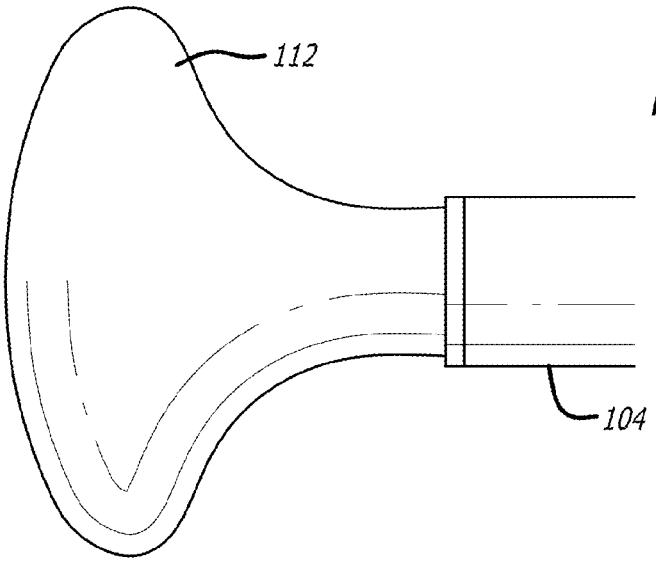
FIG. 11 is an example of a handle that with be used with the muscle therapy device.

The changeability of the handles, including a hand contoured carbon fiber handle 112 as shown in FIG. 11, allows the user to effectively replicate the feel and correct movements of a canoe and stand up paddle boarder that allows a smoother movement and grip. A key movement in shoulder, back, spine and core rehabilitation. Different handles with various ranges of shapes and contours can be utilized which can offer a greater range of muscle therapy. For example, the balls may have a smooth surface made of rubber or the balls may have rippled, lumpy and/or spiky textures for offering a greater range of soft and deep tissue therapy.

According to one aspect, the elongated shaft 102 may include one or more points of attachments placed along the shaft, for securing attachment members 114 thereto. The attachment members 114 may be secured in holes specifically designed for detachably receiving the attachments members 114 or the attachment members 114 may be integrally connected to the elongated shaft 102.

Figure 9:
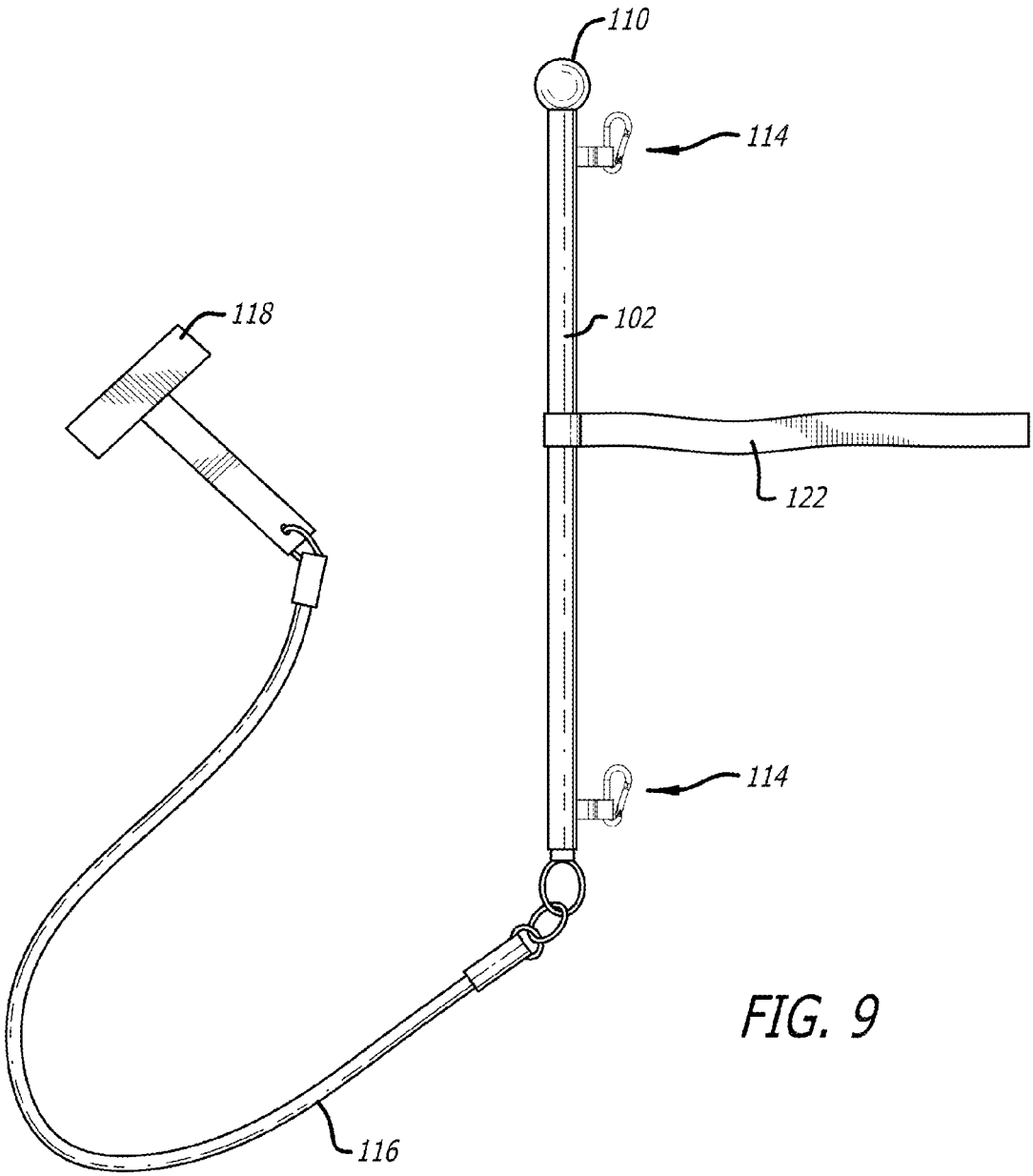
FIG. 9 is a muscle therapy device according to one embodiment.

In one embodiment, the attachment members 114 may include a strap 114*a* having a first end secured to the elongated shaft 102 and a second end forming a loop or other opening adapted to receive a securing member 114*b* or an external therapy tool. The securing member 114*b* may include, but is not limited to, carbineer clips, rubber bands and screws. The external therapy tools may include, but are not limited to, resistance bands 116 (FIG. 9), ropes, pulleys, handles 118 and door anchors 120 (See FIG. 12). Unlike known devices, the muscle therapy device described herein offers the ability to mobilize and activate at the same time. The ball is the mobilizer while the resistance bands act as the activator. A set of resistance bands that come in various lengths, colors and tension levels that can be clipped onto the shaft to perform physical therapy exercise and fitness training may be utilized. Handles, ankle straps and carabineer clips may be used to attach the resistance bands to a user's limbs.

According to one aspect, the distal end 102*b* of the elongated shaft 102 may include a loop, hook or other fastener adapted to receive a therapy tool secured thereon. (See FIG. 9) A resistance band 122 may also be wrapped around or tied onto the elongated shaft 102.

According to one aspect, a coiled protective cover may be added over the resistance bands to increase longevity of the band by reducing tears and nicks in the rubber.

According to one aspect, instead of using carabineer clips to attach the resistive bands to the shaft; handles, ankle straps, a door anchor or a button clip, for example, may be used. An external clamp that attaches onto the elongated shaft 102 already attached to a custom resistance band may also be used.

Figure 12:
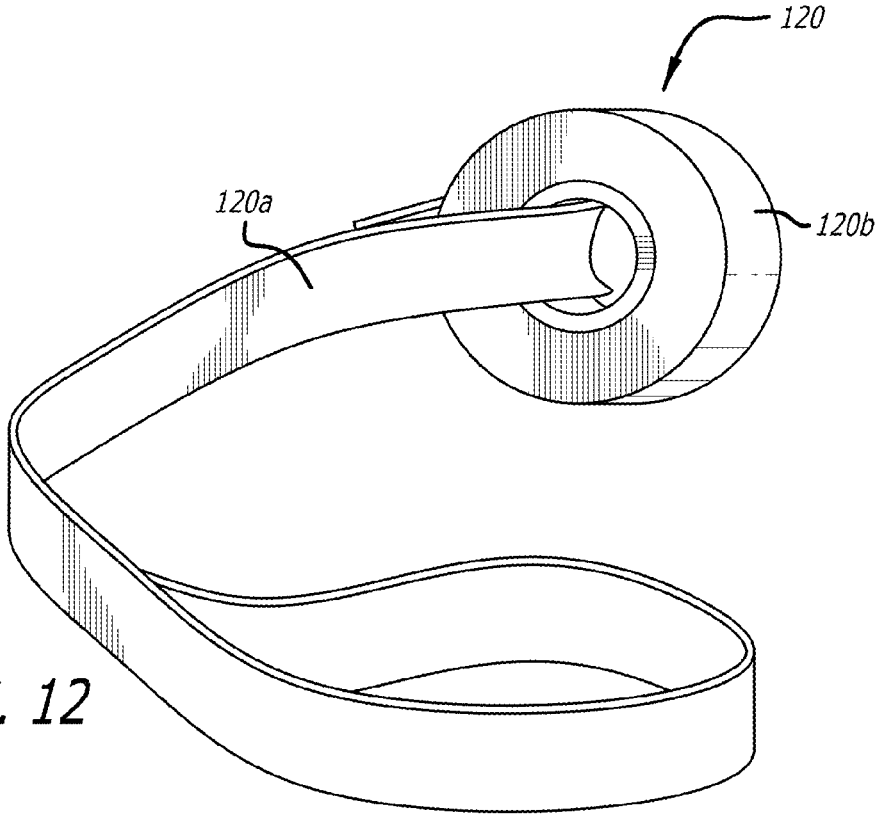
FIG. 12 is an example of a door anchor that may be used with the muscle therapy device.

According to one aspect, the use of the door anchor 120 may provide greater versatility, allowing for the functional training bar to attach the resistance bands, handles and/or straps attached to both the door anchor 120 and the bar. FIG. 12 illustrates an example of a door anchor 120 that may be used, although any door anchor known in the art may be utilized. As shown, the door anchor may include a strap 120*a* secured to an anchor 120*a*. Although the anchor 120*a* is shown having a circular configuration, this is by way of example only and the anchor 120*a* can have any shape.

Figure 13:
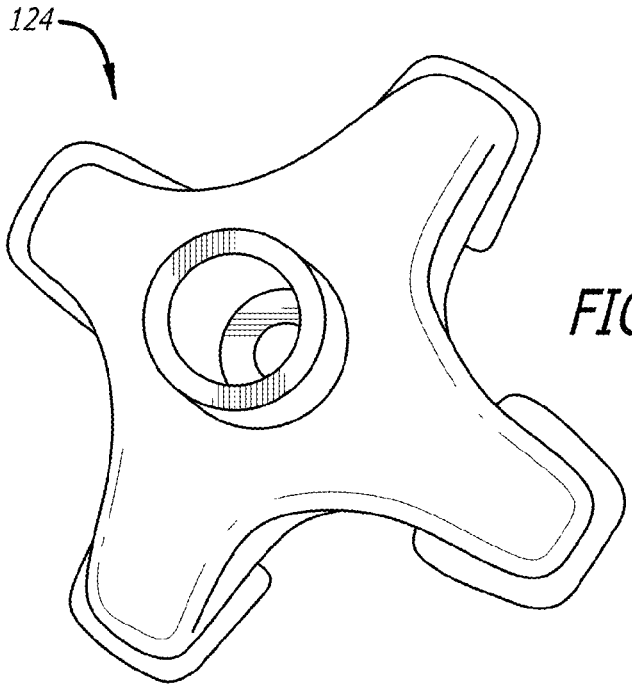
FIG. 13 is an example of a base for use with the muscle therapy device according to a first embodiment.
Figure 14:
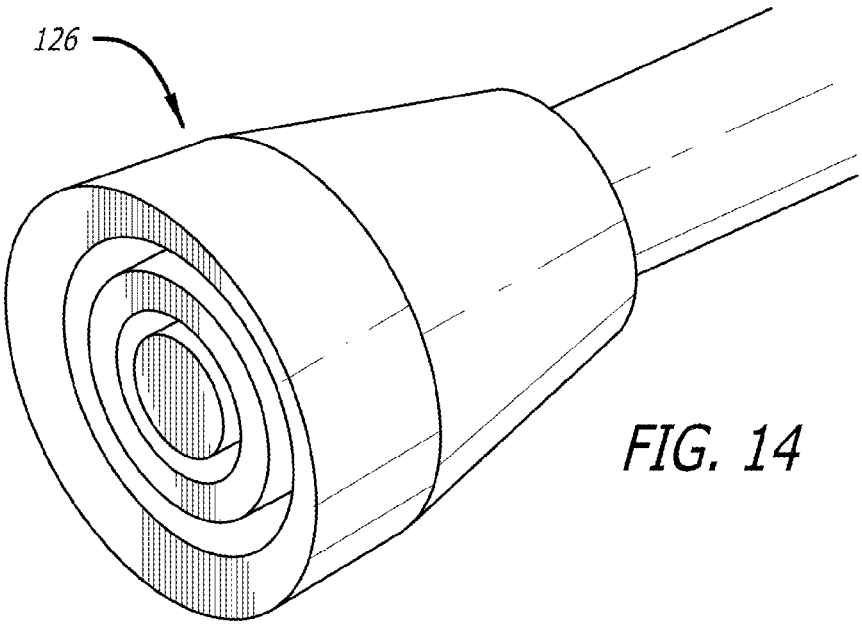
FIG. 14 is an example of a base for use with the muscle therapy device according to a second embodiment.

According to one aspect, different sized and shaped bases may be secured to the proximal end of a segment, such as the third segment. Examples of two such bases 124, 126 are shown in FIGS. 13 and 14. The base may be made of rubber or any other material known in the art. While a smaller base 124, as shown in FIG. 13, may be ideal for travel, a larger base 126, as shown in FIG. 14, may provide the user more stability and safety when using the muscle therapy device 100. That is, the bases or the rubber stoppers can be changed from small to large allowing travel options and wider footprints which provides for greater safety, grip and stability. The larger base 126 may include, but is not limited to, a tripod base rubber stopper (not shown) or a quad tip rubber stopper (see FIG. 14).

Figure 15:
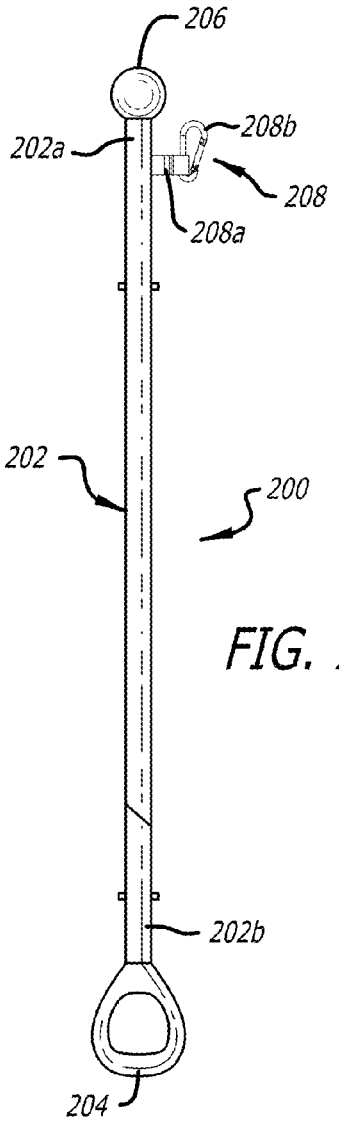
FIG. 15 is a muscle therapy device according to one embodiment.

FIG. 15 illustrates another example of a muscle therapy device 200. The muscle therapy device 200 may include an elongated shaft 202 extending along an axis and having a proximal end and a distal end. The elongated shaft 202 may be made of the strongest and most lightweight metal or other material that is available. For example, the elongated shaft 202 may be made of carbon fiber, aluminum or wood.

According to one aspect, the elongated shaft 202 may be comprised of a first segment 202*a* detachably secured to a second segment 202*b*. The second segment 202*b* may include a handle 204 detachably secured thereon. The segments may have the same lengths or be of different lengths. By utilizing a plurality of detachable segments, the elongated shaft 202 can be easily dismantled for storage or travel as well as allowing users to adjust the length of the elongated shaft 202 to better suit each individual user. The first segment 202*a* and the second segment 202*b* may be but on 45 degree angles to ensure the strongest possible connection in the shaft when secured together. This 45 degree locking cut maximizes force transfer through the elongated shaft 202. A ball 206 may be detachably secured to the first segment 202*a* of the elongated shaft 202. Alternatively, the ends may be cut at other angles. As described above, the segments may be detachably secured together using a pushable button extending outward on one segment for insertion into one of a plurality of holes on a second segment. The length of the elongated shaft 202 may be adjusted by the selection of the hole into which the button is inserted as the plurality of holes extending along the longitudinal axis of a segment which each hole a different distance from the end.

According to one aspect, the elongated shaft 202 may include one or more points of attachments placed along the shaft, for securing attachment members 208 thereto. The attachment members 208 may be secured in holes specifically designed for detachably receiving the attachments members 208 or the attachment members 208 may be integrally connected to the elongated shaft 202.

In one embodiment, the attachment members 208 may include a strap 208*a* having a first end secured to the elongated shaft 202 and a second end forming a loop or other opening adapted to receive a securing member 208*b* or an external therapy tool. The securing member 208*b* may include, but is not limited to, carbineer clips, rubber bands and screws. The external therapy tools may include, but are not limited to, resistance bands, ropes, pulleys, handles and door anchors.

Figure 16:
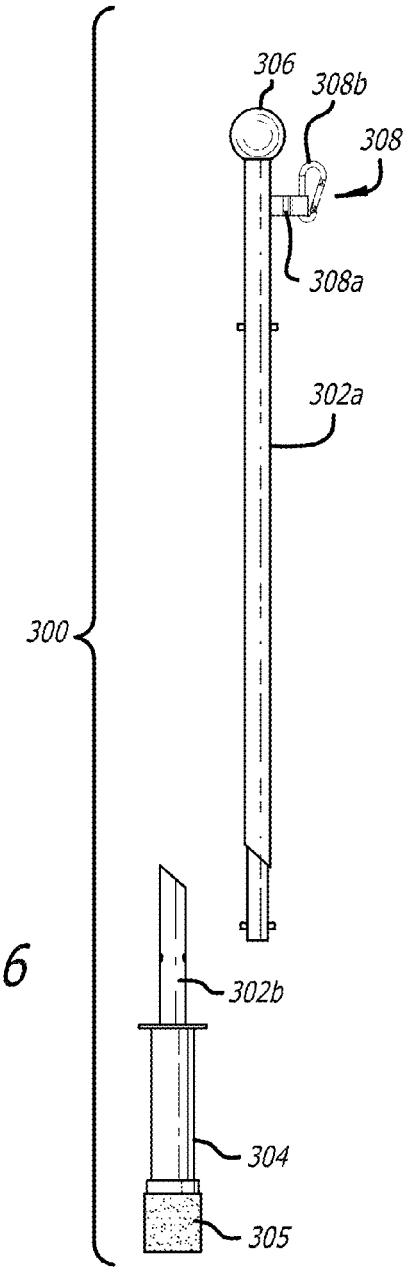
FIG. 16 is an exploded view of a muscle therapy device according to one embodiment.

FIG. 16 is an exploded view of a muscle therapy device 300 according to one embodiment. As shown, the muscle therapy device 300 may include an elongated shaft extending along an axis and having a proximal end and a distal end. The elongated shaft may be made of the strongest and most lightweight metal or other material that is available. For example, the elongated shaft may be made of carbon fiber, aluminum or wood.

According to one aspect, the elongated shaft may be comprised of a first segment 302*a* detachably secured to a second segment 302*b*. The second segment 302*b* may include a handle 304 detachably secured thereon. The handle 304 may include a pad 305 fixedly or detachably secured to an end or the base of the handle 305. The pad 305 may be a padded cushion at the base of the handle that allows a user, such as a physical therapist, to more comfortably position the handle 304 (i.e. padded side handle into the therapist's front hip or chest/shoulder area and the ball end of the device into the base of the neck, hips, underarm areas of the patient among other locations. This allows the therapist to use his body weight to perform specific physical therapy active release techniques that would normally require the therapist to have to get into extremely difficult or bad posture positions to perform in addition to having to use a lot more physical force. As such, the pad 305 at the end of the handle 304 saves the therapist from potential injury and also results in a stronger, more controlled solution.

The segments of the muscle therapy device 300 may have the same lengths or be of different lengths. By utilizing a plurality of detachable segments, the elongated shaft 302 can be easily dismantled for storage or travel as well as allowing users to adjust the length of the elongated shaft to better suit each individual user. The first segment 302*a* and the second segment 302*b* may be cut on 45 degree angles to ensure the strongest possible connection in the shaft when secured together. This 45 degree locking cut maximizes force transfer through the elongated shaft. A ball 306 may be detachably secured to the first segment 302*a* of the elongated shaft. Alternatively, the ends may be cut at other angles. As described above, the segments may be detachably secured together using a pushable button extending outward on one segment for insertion into one of a plurality of holes on a second segment. The length of the elongated shaft 202 may be adjusted by the selection of the hole into which the button is inserted as the plurality of holes extending along the longitudinal axis of a segment which each hole a different distance from the end.

According to one aspect, the elongated shaft 302 may include one or more points of attachments placed along the shaft, for securing attachment members 308 thereto. The attachment members 308 may be secured in holes specifically designed for detachably receiving the attachments members 308 or the attachment members 308 may be integrally connected to the elongated shaft 302.

Compression Flossing

Figure 17:
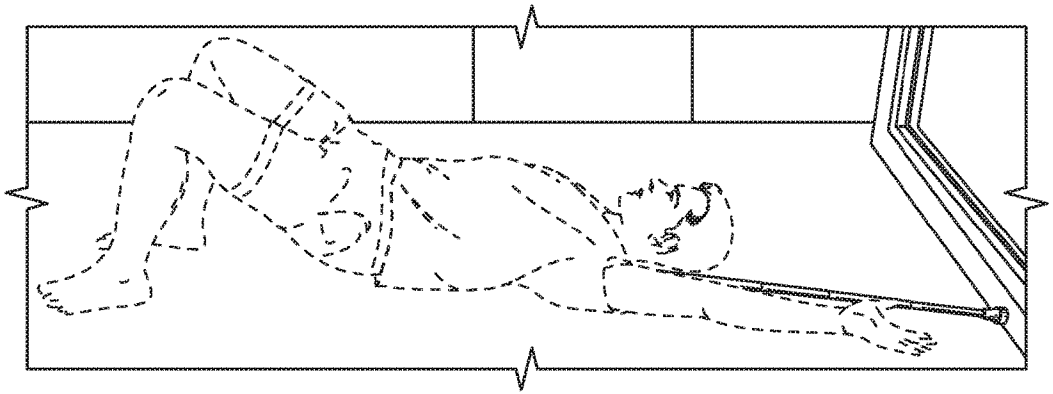
FIG. 17 illustrates a pose of a user using an embodiment of the muscle therapy device to perform compression flossing.

FIG. 17 illustrates a pose of a user using an embodiment of the muscle therapy device to perform compression flossing. The muscle therapy device described above may be used for various exercises including compression flossing. In this example, the user may utilize the muscle therapy device without any attachments, i.e. utilize the elongated shaft with a ball detachably secured to the distal end of the elongated shaft and a rubber base detachably secured to the proximal end of the elongated shaft.

The user may lay with his back on the floor with the ball positioned into the first rib/base of the neck while the base is pushed up against a wall. As is known in the field of physical therapy, various rehabilitation movements to the neck and shoulder can be performed in this position. In other example, resistance bands can be added to increase the difficulty of the exercises.

Figure 18:
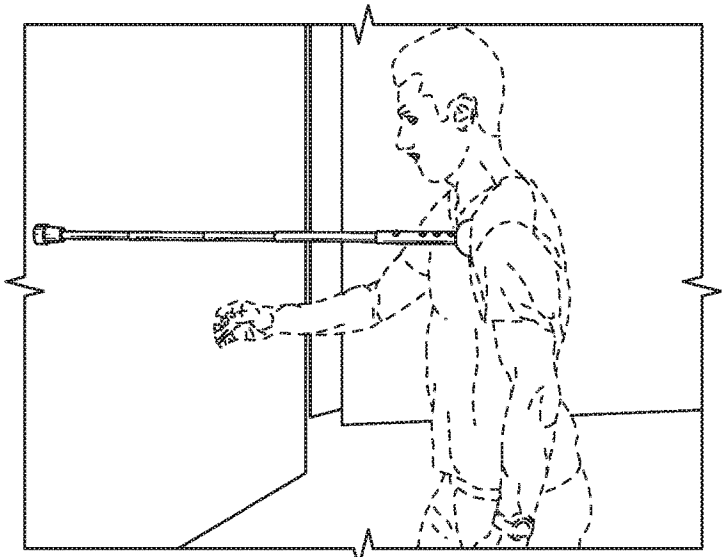
FIG. 18 illustrates another pose of a user using an embodiment of the muscle therapy device to perform compression flossing.
Figure 19:
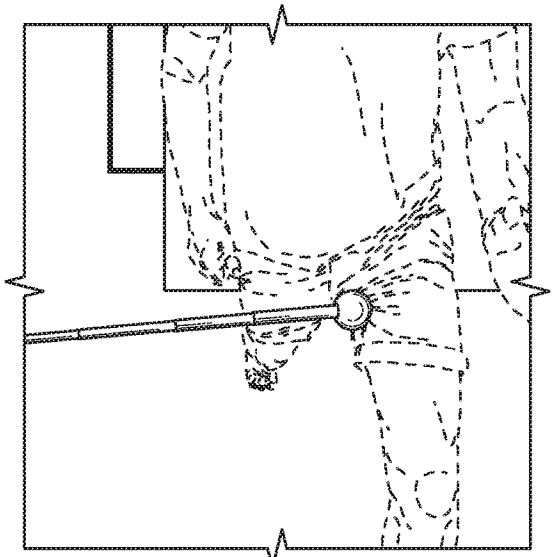
FIG. 19 illustrates yet another pose of a user using an embodiment of the muscle therapy device to perform compression flossing.

FIGS. 18 and 19 illustrate additional poses of a user using an embodiment of the muscle therapy device to perform compression flossing. In this example, the user stands and positions the ball into various locations on the body from their chest, shoulder, rib cage, hips and abdomen while the base of the elongated shaft is pushed up against the wall. Once in place, the user can push into the ball to create compression and performs therapy exercises.

Figure 20:
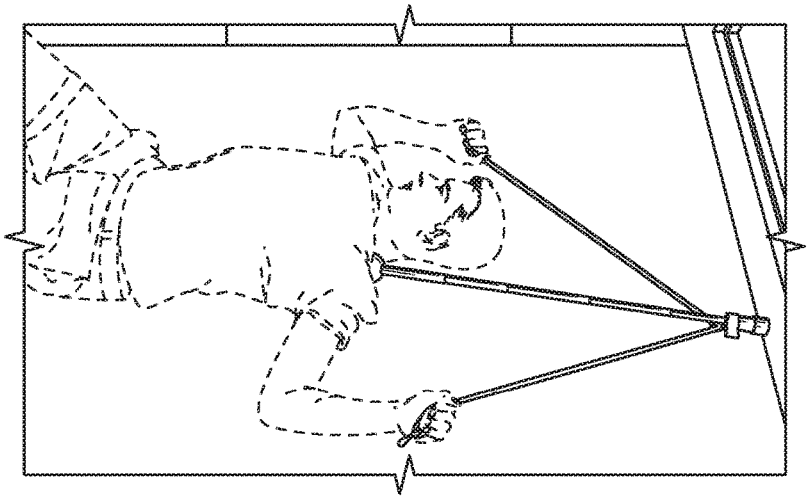
FIG. 20 illustrates a pose of a user using an embodiment of the muscle therapy device as a functional training bar.

FIG. 20 illustrates yet another pose of a user using an embodiment of the muscle therapy device to perform compression flossing. This example of an exercise that may be practiced with the muscle therapy device described above again involves the user laying with his back on the floor with the ball positioned into the first rib/base of the neck while the base is pushed up against a wall. A resistance band may be detachably secured to the end of the muscle therapy device contacting the wall and the user may hold the resistance band to add function after the compression flossing to create compression and activation.

Functional Training Bar

Figure 21:
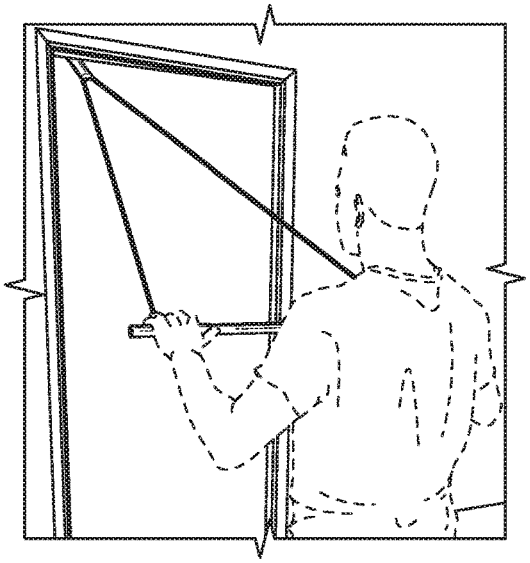
FIG. 21 illustrates another pose of a user using an embodiment of the muscle therapy device as a functional training bar.
Figure 22:
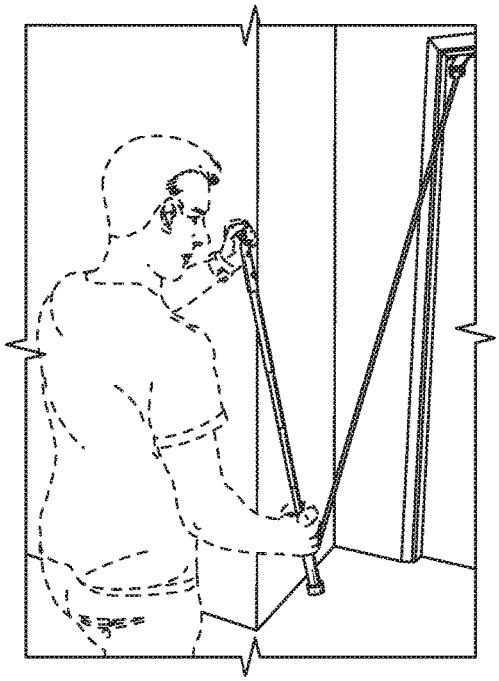
FIG. 22 illustrates yet another pose of a user using an embodiment of the muscle therapy device as a functional training bar.

FIGS. 21 and 22 illustrate poses of a user using an embodiment of the muscle therapy device as a functional training bar. The elongated shaft may convert into a functional resistance training bar that can attach resistance bands and door anchors to perform rehabilitation and full fitness exercises. The elongated shaft can be converted into two separate or individual smaller bars and each separate bar may be attached to a door anchor or sturdy pillar. The user can then perform a wide range of fully body exercises with the bar, such as the rehabilitation of the neck, back and shoulders.

The three piece shaft component allows the user to change the length of the bar, convert the bar into two separate bars, one in each hand and attach a resistance band on each of the shaft. That is, the elongated shaft can be split in two, allowing more diversity in resistance training using the resistance bands and door anchor. Conventional products have a fixed bar limiting the volume of movements to cater for muscular or joint imbalances.

Unlike prior art device, the muscle therapy device of the present disclosure offers a customized ball that secures tightly to the pole with interchangeable sizes and textures as well as a portable three piece shaft for traveling. One of the risks and dangers of the prior art do-it-yourself versions is that they do not offer a secure lock from the ball attached to the pole nor offer various sizes, or ball density from soft to firm.

The muscle therapy device of the present disclosure also provide for the ability to change base based on particular needs and locations. For example, small or wide footprint rubber stoppers may be used at the proximal end of the elongated shaft for better grip against a wall for better traction and safety.

One or more of the components and functions illustrated in the figures may be rearranged and/or combined into a single component or embodied in several components without departing from the invention. Additional elements or components may also be added without departing from the invention. Additionally, the features described herein may be implemented in software, hardware, as a business method, and/or combination thereof.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A portable muscle therapy device, comprising: an elongated shaft extending along an axis and having a proximal end and a distal end; two attachment members, each attachment member comprising an elongated strap extending substantially perpendicular to the axis and outwardly from a single hole in one side of the elongated shaft, and a securing member detachably fixed to the elongated strap, wherein when the device is in use, the elongated straps each have an unlooped first end secured directly and respectively to the proximal and distal ends of the elongated shaft, and wherein each attachment member secures an object to the elongated shaft; and a therapy tool received on the distal end of the elongated shaft.

2. The device of claim 1, wherein the object is a resistance band.

3. The device of claim 1, wherein the object is a door anchor.

4. The device of claim 1, wherein the securing member is a carabineer clip.

5. The device of claim 1, further comprising a base received in the proximal end of the elongated shaft.

6. The device of claim 1, wherein the therapy tool is selected from at least one of a ball and a handle.

7. The device of claim 1, wherein the elongated shaft comprises a plurality of detachable segments.

8. The device of claim 1, further comprising:

a first locking mechanism for selectively locking a first segment of a plurality of segments of the elongated shaft relative to a second segment of the plurality of segments along the axis; and a second locking mechanism for selectively locking the second segment of the plurality of segments relative to a third segment of the plurality of segments along the axis.

9. The device of claim 8, wherein the first locking mechanism comprising a pushable button on an end of the first segment and a plurality of holes extending along a longitudinal axis of the second segment; and wherein the pushable button is received in a hole in of the plurality of holes detachably securing the first segment to the second segment.

10. A portable muscle therapy device, comprising: an elongated shaft extending along an axis and having a proximal end and a distal end, the elongated shaft comprising a plurality of detachable segments; one or plural attachment points located on one or plural of the plurality of detachable segments; one or plural attachment members adapted to be respectively received in the one or plural attachment points, the one or plural attachment members securing an object to the elongated shaft; a first therapy tool received on the distal end of the elongated shaft; wherein the plurality of detachable segments includes a first segment and a second segment; and wherein adjoining ends of the first and second segments are cut on 45 degree angles.

11. The device of claim 10, further comprising a base detachably secured to the proximal end of the elongated shaft.

12. The device of claim 10, further comprising a handle detachably secured to the proximal end of the elongated shaft adapted to be placed against a portion of a first user's body when in use and wherein the first therapy tool is adapted to be placed against a portion of a second user's body when in use.

13. The device of claim 12, further comprising a padded cushion secured to an end of the handle.

14. The device of claim 10, further comprising:

a first locking mechanism for selectively locking the first segment of the plurality of detachable segments relative to the second segment of the plurality of detachable segments along the axis; and a second locking mechanism for selectively locking the second segment of the plurality of detachable segments relative to a third segment of the plurality of detachable segments along the axis.

15. The device of claim 14, wherein the first locking mechanism comprising a pushable button on an end of the first segment and a plurality of holes extending along a longitudinal axis of the second segment; and wherein the pushable button is received in a hole in of the plurality of holes detachably securing the first segment to the second segment.

16. The device of claim 10, wherein the one or plural attachment members comprising a strap extending outwardly from the one or plural attachment points, the strap adapted to receive a second therapy tool.

17. The device of claim 16, wherein the strap includes a loop at one end adapted to receive a securing member adapted to receive the second therapy tool.

18. The device of claim 10, wherein the object first therapy tool is a ball.

* * * * *